United States Patent [19]

Dessau et al.

[11] Patent Number: 4,882,040

[45] Date of Patent: Nov. 21, 1989

[54] REFORMING PROCESS

[75] Inventors: Ralph M. Dessau, Edison, N.J.; Ernest W. Valyocsik, Yardley, Pa.

[73] Assignee: Mobil Oil Corporation, New York, N.Y.

[21] Appl. No.: 210,949

[22] Filed: Jun. 24, 1988

[51] Int. Cl.[4] ..... C10G 35/06

[52] U.S. Cl. ..... 208/138

[58] Field of Search ..... 208/138

[56] References Cited

U.S. PATENT DOCUMENTS

| | | | |
|---|---|---|---|
| Re. 29,948 | 3/1979 | Dwyer et al. | 208/110 |
| 3,702,293 | 11/1972 | Hayes et al. | 208/139 |
| 3,702,294 | 11/1972 | Rausch | 208/139 |
| 3,878,125 | 4/1975 | Mitsche et al. | 502/73 |
| 3,878,131 | 4/1975 | Hayes | 252/466 PT |
| 4,104,320 | 8/1978 | Bernard et al. | 260/673.5 |
| 4,276,151 | 1/1981 | Plank et al. | 208/138 |
| 4,325,808 | 4/1982 | Kim et al. | 208/65 |
| 4,347,394 | 8/1982 | Detz et al. | 585/419 |
| 4,387,258 | 6/1983 | Vadekar et al. | 585/259 |
| 4,416,806 | 11/1983 | Bernard et al. | 502/74 |
| 4,418,006 | 11/1983 | Kim et al. | 502/73 |
| 4,435,283 | 3/1984 | Buss et al. | 208/138 |
| 4,456,527 | 6/1984 | Buss et al. | 208/89 |
| 4,486,547 | 12/1984 | Imai et al. | 502/223 |
| 4,487,843 | 12/1984 | Telford et al. | 502/85 |
| 4,487,848 | 12/1984 | Robinson et al. | 502/223 |
| 4,547,472 | 10/1985 | Nordstrand | 502/66 |
| 4,576,805 | 3/1986 | Chang et al. | 423/277 |
| 4,588,495 | 5/1986 | Franck et al. | 208/65 |
| 4,604,371 | 8/1986 | Moorehead | 502/60 |
| 4,614,834 | 9/1986 | Lambert et al. | 585/419 |
| 4,619,906 | 10/1986 | Lambert et al. | 502/66 |

FOREIGN PATENT DOCUMENTS

| | | |
|---|---|---|
| 0107389 | 4/1984 | European Pat. Off. . |
| 2033358 | 5/1980 | United Kingdom . |
| 2114150 | 8/1983 | United Kingdom . |

OTHER PUBLICATIONS

G. Wenqui et al., "IR Study of Framework Vibrations and Surface Properties High Silica Zeolites", ZEOLITES, Elsevir Science, Amsterdam, 1985, p. 279.

Ione, Journal of Molecular Catalysis, 31, pp. 355–370 (1985).

Ione, Elsevir Science, (1984), pp. 151–158.

Huagong, vol. 15, No. 7 (1986) (with translation).

Seventh International Zeolite Conference, "Preprints of Poster Papers", Japan Association of Zeolite, Tokyo, Japan (Aug. 17–22, 1986), pp. 309–310.

*Primary Examiner*—Curtis R. Davis

*Attorney, Agent, or Firm*—Alexander J. McKillop; Charles J. Speciale; Marina V. Schneller

[57] ABSTRACT

An improved, low-pressure reforming process based on non-acidic metal containing crystalline microporous catalyst, in which the feed is a naptha rich in $C_6$–$C_7$ low octane hydrocarbons, such as paraffins, and in which the reformate has increased aromatic content and increased octane value over that of the feed.

40 Claims, No Drawings

REFORMING PROCESS

FIELD OF THE INVENTION

The invention resides in catalytic reforming of naphthas having low octane values to increase that octane value. The catalyst comprises a non-acidic platinum containing crystalline microporous material. Reforming process catalyzed by a non-acidic Pt containing composition which comprises a zeolite formed in the presence of thallium or lead. $C_6$ and $C_7$ paraffin components are converted into aromatics, in a conversion of high selectivity for aromatic production and low, if any, selectivity for hydrogenolysis. A result of the catalytic process of the invention is an increase in liquid yields by minimizing, if not eliminating, the cracking of $C_5$+ hydrocarbons such as $C_6$ and $C_7$ paraffins.

BACKGROUND OF THE INVENTION

Catalytic reforming is a process in which hydrocarbon molecules are rearranged, or reformed in the presence of a catalyst. The molecular rearrangement results in an increase in the octane rating of the feedstock. That is, during reforming low octane hydrocarbons in the gasoline boiling range are converted into high octane components by dehydrogenation of naphthenes and isomerization, dehydrocyclization and hydrocracking of paraffins.

By way of illustration, the significance of those reactions in reforming can be gleaned from a review of the following table from "Catalysis," vol VI, P. H. Emmett (ed). Copyright 1958 by Litton Educational Publishing Company:

Octane Numbers of Pure Hydrocarbons

| Hydrocarbon | Blending research octane number (clear) |
|---|---|
| Paraffins | |
| n-Butane | 113 |
| n-Pentane | 62 |
| n-Hexane | 19 |
| n-Heptane | 0 |
| n-Octane | −19 |
| 2-Methylhexane | 41 |
| 2,2-Dimethylpentane | 89 |
| 2,2,3-Trimethylbutane | 113 |
| Naphthenes (cycloparaffins) | |
| Methylcyclopentane | 107 |
| 1.1-Dimethylcyclopentane | 96 |
| Cyclohexane | 110 |
| Methylcyclohexane | 104 |
| Ethylcyclohexane | 43 |
| Aromatics | |
| Benzene | 99 |
| Toluene | 124 |
| 1,3-Dimethylbenzene | 145 |
| Isopropylbenzene | 132 |
| 1,3,5-Trimethylbenzene | 171 |

Naphtha reforming may also be utilized for the production of benzene, toluene, ethylbenzene, and xylene aromatics. A valuable by-product of naphtha reforming is hydrogen, which may be utilized for hydrotreating and upgrading of other hydrocarbon fractions. Generally, the molecular rearrangement of molecular components of a feed, which occurs during reforming, results in only slight, if any, changes in the boiling point of the reformate (the product of reforming), compared to that of the feed. Accordingly, reforming differs from both cracking and alkylation, both refinery processes, each of which does result in changes of boiling range of the product compared to the feed. That is, in cracking, large molecules are cracked into smaller ones; whereas, in alkylation small molecules are rebuilt into larger molecules.

The most important uses of the reforming process are briefly mentioned: the primary use of catalytic reforming may be concisely stated to be an octane upgrader and a route to premium gasoline. Catalytic reforming is the only refining process that is capable of economically making a gasoline component having high clear research octane ratings. The charge to the reformer (straight-run, thermal, or hydrocracker naphtha) is usually available in large quantitites and is of such low quality that most of it would be unsaleable without reforming.

A correlative use of catalytic reforming is in its ability to produce gasolines of acceptable volatility over a wide range of yields, through proper selection of feedstock and/or operating conditions. The refiner is thus able to vary the yield of gasoline very substantially to meet demand fluctuations. For European demand patterns, where gasoline sales are limiting and it is desired to produce as much middle distillate as practicable, the reformer can be operated on a lighter, lower volume of naphtha to minimize gasoline production while maintaining high crude runs.

Hydrogen, although often considered a by-product, is still a valuable output from the reformer. Normally, it is produced in amounts ranging from 300 to 1200 SCF/Bbl, depending on the type of feed stock and reformer operating conditions. Reformer hydrogen is used to remove unwanted contaminants from reformer feed stocks, for hydrodesulfurization of distillates, hydrocracking of heavy fractions, hydrotreating of lubes and various chemical operations. Hydrogen availability and utilization is expected to assume increasing importance as pollution restrictions lead to increasing hydroprocessing in future years.

THe importance of reforming is reflected by data which indicates that finished pool gasoline is about 35% reformate in complex refineries, but can run as high as 80% in topping-reforming refineries. As lead is phased out of gasoline, more and more straight run stocks which are now blended directly into gasoline will be reformed. All current commercial reformers use a platinum containing catalyst with a hydrogen recycle stream. Within this broad definition, there are a great number of different process designs. More than 75% of the industry's reforming capacity is classified as semi-regenerative. A semi-regenerative reformer is one which runs until the catalyst is coked and then is shut down and regenerated. The time period between regenerations varies from several months to as long as 1½ years.

Within the category of semi-regenerative reforming, a further breakdown can be made on the basis of operating pressure. Units with separator pressures of 450 psig or higher are considered high pressure units. Those with pressures of 300 psig or less are called low pressure units. Anything in between is intermediate pressure. Most of the older units are high pressure, while the newer designs are low or intermediate pressure. Lower pressures give better reformate yields at a given octane level.

Another type of reformer is the cyclic variety. A cyclic unit has the reactors manifolded in such a way that any reactor can be taken out of reforming service and regenerated while the other reactors are still reforming. The time period between regenerations for a cyclic reactor varies from 2 to 10 days. All cyclics are low pressure.

A third type of reformer that has recently been commercialized is the continuous unit. In this type of reformer, catalyst is withdrawn from the unit during reforming, regenerated in small batches in separate regeneration facilities and then replaced in the unit. The regeneration period for continuous units is about one month. As in the case for cyclic units, all continuous units are low pressure.

Prior to about 1950 chromium oxide or molybdenum oxide supported on alumina were used to effect the two functions of a reforming catalyst. The hydrogenation-dehydrogenation function for paraffin olefin conversion during reforming is effected by the metals chromium and molybdenum and more recently platinum, rhenium, admixtures thereof and noble-metal containing trimetallic alloys. Isomerization activity was provided by acidified alumina.

From the commercialization of platinum reforming in the middle 1950's to the late 1960's, there were no significant improvements in reforming catalysts.

In the late 1960's a dramatic breakthrough in reforming catalysts occurred. This was the introduction of the platinum-rhenium bimetallic catalysts. These catalysts have greatly improved stability compared to platinum-only catalysts. By way of background, the platinum and platinum bimetallic catalysts were generally supported on carriers.

Recently, the patent literature has started to recognize the use of platinum and non-shape selective zeolite containing catalyst compositions in reforming. For example, that is the zeolite may replace in whole or in part the function of alumina in prior reforming catalysts. U.S. Pat. No. 4,456,527 describes zeolite L as a component in a composition for catalyzing reforming.

Zeolites include naturally occurring and synthetic zeolites. They exhibit catalytic properties for various types of hydrocarbon conversions. Zeolites are porous crystalline aluminosilicates having definite crystalline structure as determined by X-ray diffraction studies. Such zeolites have pores of uniform size which are uniquely determined by unit structure of the crystal. The zeolites are referred to as "molecular sieves" because interconnecting channel systems created by pores of uniform pore size allow a zeolite to selectively absorb molecules of certain dimensions and shapes.

By way of background, one authority has described the zeolites structurally, as "framework" aluminosilicates which are based on an infinitely extending three-dimensional network of $AlO_4$ and $SiO_4$ tetrahedra linked to each other by sharing all of the oxygen atoms. Furthermore, the same authority indicates that zeolites may be represented by the empirical formula $$M_{2/n}O.Al_2O_3.xSiO_2.yH_2O$$

In the empirical formula, x is equal to or greater than 2, since $AlO_4$ tetrahedra are joined only to $SiO_4$ tetrahedra, and n is the valence of the cation designated m. D. Breck, ZEOLITE MOLECULAR SIEVES, John Wiley & Sons, New York p. 5 (1974). In the empirical formula, the ratio of the total of silicon and aluminum atoms to oxygen atoms is 1:2. M was described therein to be sodium, potassium, magnesium, calcium, strontium and/or barium, which complete the electrovalence makeup of the empirical formula.

The prior art describes a variety of synthetic zeolites. These zeolites have come to be designated by letter or other convenient symbols, as illustrated by the zeolite. The silicon/aluminum atomic ratio of a given zeolite is often variable. Moreover, in some zeolites, the upper limit of the silicon/aluminum atomic ratio is unbounded. ZSM-5 is one such example wherein the silicon/aluminum atomic ratio is at least 2.5 and up to infinity. U.S. Pat. No. 3,941,871, reissued as RE. 29,948, discloses a porous crystalline silicate made from a reaction mixture containing no deliberately added aluminum and exhibiting the X-ray diffraction pattern characteristic of ZSM-5. Various patents describe inclusion of elements other than silicon and aluminum in the preparation of zeolites. Cf. U.S. Pat. No. 3,530,064, U.S. Pat. Nos. 4,208,305 and 4,238,318 describe the preparation of silicates in the presence of iron.

Zeolites may be classified by pore size. ZSM-5 is a member of a class of zeolites sometimes referred to as medium pore zeolites. The pore sizes of medium pore zeolites range from about 5 to about 7 Angstroms.

Another class of zeolites sometimes referred to as large pore zeolites include inter alia naturally occurring faujasite, synthetic zeolites X, L, Y and zeolite beta. These zeolites are characterized by pore sizes greater than those of the medium pore zeolites. The pore sizes of large pore zeolites are greater than about 7 Angstroms. Because of the larger pore sizes these latter zeolites may be less (molecule) shape selective.

SUMMARY OF THE INVENTION

Naphthas, rich in $C_6$ and $C_7$ paraffins, difficult to reform selectively using conventional catalysts, are reformed over non-acidic catalyst compositions containing a reforming metal and non-acidic crystalline microporous materials containing thallium or lead modifiers. The reformate produced thereby is characterized by higher net yield of aromatic gasoline than would result from reforming in the presence of conventional reforming catalysts. Moreover, products of reforming in accordance with the invention contain reduced $C_3+C_4$ fractions.

DETAILED DESCRIPTION OF THE INVENTION

The Feedstocks

The feedstock charge to the new reforming process can be straight-run, thermal, or catalytically cracked naphtha. Typically, naphthas boil at 80° to 400° F. Preferably, for high increases in the aromatic content and high octane numbers of the reformate, the charge to the reformer is a naphtha rich in paraffins; these are generally difficult to reform selectively using conventional catalysts (such as chlorided Pt-alumina).

Naphtha fractions boiling below 150° F., which contain pentanes and methylpentanes, are preferably taken as gasoline by blending or processed separately. The higher boiling fractions, for example, 150°-400° F. which contain $nC_6+$ paraffins are processed at reforming conditions over the catalyst used in this invention. In one embodiment, the naphtha is separated into fractions, at least one of which is processed.

For example, the 180°-250° F. light naphtha fraction containing $C_6$-$C_7$ paraffins is processed over the non-acidic catalyst composition. This light naphtha fraction is difficult to convert selectively to aromatics over traditional dual functional reforming catalysts, where paraffin isomerization and hydrocracking reactions compete. The remaining 250° F. fraction can be processed over conventional reforming catalyst with yield and/or octane gains greater than that obtained by conventional reforming alone.

The naphtha fractions may be hydrotreated prior to reforming; but hydrotreating is not necessarily required when using the catalyst in accordance with the invention.

Initial hydrotreating of a hydrocarbon feed serves to convert sulfur, nitrogen and oxygen derivatives of hydrocarbon to hydrogen sulfide, ammonia, and water while depositing metal contaminant from hydrodecomposition of any organo-metal compounds. Where desired, interstage processing of the effluent from the hydrotreating zone may be effected. Such interstage processing may be undertaken, for example, to provide additional hydrogen, to add or remove heat or to withdraw a portion of the hydrotreated stream for treatment which need not be reformed. Hydrotreating of the heavy naphtha fraction may be essential, prior to reforming in a conventional reforming process. Suitably, the temperature in the hydrotreating catalyst bed will be within the approximate range of 550° F. to 850° F. The feed is conducted through the bed at an overall space velocity between about 0.1 and about 10 and preferably between about 0.2 and about 2, with hydrogen initially present in the hydrotreating zone in an amount between about 1000 and 10,000 standard cubic feed per barrel of feed, corresponding to a ratio of between about 2.4 and about 24 moles of hydrogen per mole of hydrocarbon.

The catalyst may be any of the known hydrotreating catalysts, many of which are available as staple articles of commerce. These hydrotreating catalysts are generally metals or metal oxides of Group VIA and/or Group VII deposited on a solid porous support, such as silica and/or metal oxides such as alumina, titania, zirconia or mixtures thereof. Representative Group VIA metals include molybdenum, chromium and tungsten and Group VIII metals include nickel, cobalt, palladium and platinum. These metal components are deposited, in the form of metals or metal oxides, on the indicated supports in amounts generally between about 0.1 and about 20 weight percent.

REFORMING CONDITIONS

When reforming is undertaken in accordance with the invention, the temperature of reforming in accordance with the invention can range from 800° F. to 1100° F., generally being greater than about 900° F., preferably 900° F. (482° C.) to 1050° F.; the pressure will be from about 1 atmosphere to 500 psig, preferably from 30 psig to 250 psig; inlet $H_2$/hydrocarbon can be 10 or less, even zero (0) as discussed in the Examples (because of hydrogen production during reforming, there will be a hydrogen partial pressure in the unit); while the LHSV (liquid hourly space velocity) can be 0.1 to 20, preferably 0.1 to 10.

In one embodiment of the invention, reforming of the heavy naphtha fraction, boiling range of up to 400° F., generally 250° to 400° F., is undertaken separately from the light naphtha fraction, by conventional reforming. As discussed above, conventional reforming may be semi-regenerative, cyclic or continuous. Process conditions in conventional reforming include pressures of about 0 to 500 psig, preferably, the pressures used herein range from 50–250 psig; temperatures of 800° to 1100° F.; $H_2$/HC molar ratios of 1 to 20:1 preferably of about 2:1 to about 6:1; LHSV of 0.1 to 20 $hr^{-1}$. Conventional reforming catalysts for this stage can include conventional reforming hydrogenation/dehydrogenation metals on aluminas. Those reforming hydrogenation/dehydrogenation metals include: platinum, platinum-rhenium; platinum with iridium, rhenium, rhodium or admixtures thereof; or platinum/tin. In the reforming process of the invention, a stream of a non-hydrogen diluent, as a cofeed, can be directed to the reforming zone. The diluent is inert in that it (the diluent) does not react directly to form aromatics, rather it is inert to aromatization which occurs under the conditions of the process.

The diluents can be helium, nitrogen, carbon dioxide, and light hydrocarbons through $C_5$ such as methane, ethane, propane, butane, pentane, ethylene, propylene, butenes, pentenes and mixtures thereof. The use of $C_3$–$C_5$ hydrocarbons as cofeeds may be particularly desirable in that they can be easily separated from the hydrogen produced in the aromatization reactions. The diluent may also be recycle of part or all of the aromatic rich reformate. Accordingly, the diluents can constitute aromatic compounds. The diluent to hydrocarbon feed molar ratio can range from 1 to about 20 with best results obtained in the range of about 2:1 to 10:1.

REFORMING CATALYST OF THE INVENTION

The reforming catalyst of the invention is a two component non-acidic catalyst comprising a reforming hydrogenation/dehydrogenation component and non-acidic crystalline microporous material containing a modifier which is thallium or lead. Preferably, that material is a crystalline microporous silicate. The hydrogenation/dehydrogenation component can be those including platinum; platinum-rhenium; platinum with iridium, rhenium, rhodium or mixtures thereof; but preferably, it is platinum. As catalysts those compositions exhibit high selectivity for paraffin dehydrogenation and/or dehydrocyclization reactions, under conditions effective for paraffin dehydrogenation and/or dehydrocyclization.

The amount of the reforming metal in the catalyst composition can range from 0.01 to 30 weight percent and preferably from 0.02 to 10 weight percent and most preferably from 0.05 to 5 weight percent.

The amount of dehydrogenation metal in the catalyst can range from 0.01 to 30 weight percent and preferably 0.1 to 10 weight percent of the non-acidic crystalline microporous modifier containing material. In a preferred embodiment, platinum is the hydrogenation/-dehydrogenation metal. However, the hydrogenation/-dehydrogenation metal can be any Group VIII metal including those of the platinum group, chromium and vanadium.

The thallium modifier content of the non-acidic crystalline microporous materials can range from 0.01 to 20 weight percent. The lead modifier content of the non-acidic crystalline microporous materials can range from 0.01 to 20 weight percent. Practically, the modifier content will range from 0.1 to 10 weight percent.

The non-acidic crystalline microporous modifier containing materials of the invention include zeolites characterized by Si/Al ratios of at least 2. However, the silica:alumina ratio of the zeolite can be up to 1000, or greater. In a preferred embodiment the aluminum content of these materials is less than 0.1 weight percent and more preferably less than 0.02 weight percent.

The non-acidic crystalline microporous thallium or lead modifier containing material of the invention can contain other elements including boron, iron, chromium and gallium. The content of these other elements in the non-acidic crystalline microporous material containing silicates can range from 0 to 10 weight percent.

The non-acidic crystalline microporous materials of the invention, described herein, are crystalline in the sense that they are identifiable as isostructural with zeolites by X-ray powder diffraction pattern. The crystalline microporous material has an X-ray diffraction pattern which corresponds to a zeolite, SAPO, ALPO, etc.

In a preferred embodiment the pore size of the non-acidic microporous crystalline containing materials ranges from about 5 to about 8 Angstroms. In a preferred embodiment the microporous crystalline material containing modifier exhibits the structure of ZSM-5, by X-ray diffraction pattern. The X-ray diffraction pattern of ZSM-5 has been described in U.S. Pat. No. 3,702,886 and RE 29,948 each of which is incorporated by reference herein.

The compositions of the invention do not exhibit any appreciable acid activity. These catalysts would meet the criteria of non-acidic catalysts described by Davis and Venuto, J. CATAL. Vol. 15, p. 363 (1969). Thus, a non-equilibrium mixture of xylenes are formed from either n-octane or each individual methylheptane isomer, with the octane yielding more o-xylene and 2-methyl-heptane yielding mostly m-xylene, at conversions between 10 and 60%.

When, as in embodiments herein, the dehydrogenation metal containing non-acidic microporous crystalline material exhibits an X-ray diffraction pattern of a zeolite, at least some of the dehydrogenation metal may be intrazeolitic, that is, some of that metal is within the pore structure of the crystal, although some of that metal can be on the surface of the crystal. A test for determining whether, for example, Pt is intrazeolitic or extrazeolitic in the case of ZSM-5 is reported by R. M. Dessau, J. CATAL. Vol. 89, p. 520 (1984). The test is based on the selective hydrogenation of olefins.

For comparison purposes, it should be noted that over dual functional platinum on acidic alumina reforming catalysts, the rate of heptane cracking $C_6^-$ was twice the rate of dehydrocyclization. Cf J. H. Sinfelt, "Bimetallic Catalysts", J. Wiley, New York; p. 141 (1983).

The crystalline materials containing lead or thallium, the modifier, can be made in various ways. Lead or thallium modifier can be incorporated during synthesis or post-synthesis; and the materials can be prepared either by stepwise or simultaneous incorporation of the modifier and the hydrogenation/dehydrogenation function to the crystallization reaction product. The dehydrogenation function can be first introduced to the synthesis product with subsequent modifier incorporation, or vice versa. Stepwise preparation includes techniques of cocrystallization, impregnation, or exchange. Crystallization can be undertaken in a two phase system described in commonly assigned Ser. No. 878,555, filed June 26, 1986. Other elements such as boron, iron, chromium, gallium, can also be included. Simultaneous incorporation includes the combination of the modifier with the dehydrogenation/hydrogenation function during synthesis (i.e., crystallization) or simultaneously after synthesis of the crystalline material.

A modifier-free precursor material can be treated with sources of the modifier at elevated temperatures. Such treatments can be conducted so that that the source is either in the gaseous or the liquid phase including the aqueous phase. Alternatively, a thallium or lead free crystalline reactant can simply be impregnated with a thallium or lead source and then calcined at temperatures above 400° C. The crystalline reactants may have high silica:alumina ratios or contain other elements such as boron, chromium, iron, and gallium. Reactants and products containing 0.1 weight percent or less aluminum are the preferred embodiments of the examples. In materials of the invention, all cation-exchangeable sites are occupied by cations other than hydrogen and other than hydrogen precursors, such as $NH_4^+$. Specifically, such sites are occupied by $Na^+$, $K^+$, $Cs^+$, $Ca^+$, $Mg^{++}$, $Ba^{++}$, $Sr^{++}$, or admixtures thereof. The alkali metals serve to neutralize any acidity due to framework aluminum. The source of alkali metal cation can derive from cations incorporated during synthesis, in excess of the aluminum content thereof. Alternatively, one can treat the final product with a basic solution of an alkali metal hydroxide as a final step prior to use, as described for example in U.S. Pat. No. 4,652,360.

The non-acidic, crystalline, microporous, modifier and dehydrogenation metal containing materials of the invention can be combined with a matrix or binder material to render them attrition resistant and more resistant to the severity of the conditions to which they will be exposed during use in hydrocarbon conversion applications. The combined compositions can contain 1 to 99 weight percent of the materials of the invention based on the combined weight of the matrix (binder) and material of the invention. When used in dehydrogenation and/or dehydrocyclization, the material of the invention will preferably be combined with non-acidic matrix or binder materials. A preferred matrix or binder material would be silica, when the materials of the invention are used in dehydrogenation/hydrogenation or dehydrocyclization.

EXAMPLE 1

Thallium ZSM-5 silicate synthesis was undertaken as follows: A solution was prepared by dissolving 0.85 g $TlNO_3$ in 170.6 g de-ionized water and then by adding 2.05 g NaOH pellets. After all the base had dissolved, 6.38 g tetrapropylammonium bromide (TPABr) was added. The resulting solution was transferred to a 300 ml stainless steel autoclave and 16.0 g of silica gel (SPEX Ind.) was stirred into the solution. The hydrogel produced can be described by the following mole ratios:

| $SiO_2/Tl_2O$: | $H_2O/SiO_2$: | $OH^-/SiO_2$: | $Na^+/SiO_2$: | $TPA^+/SiO_2$ |
|---|---|---|---|---|
| 150 | 40 | 0.20 | 0.21 | 0.10 |

The hydrogel was heated in the autoclave for 4 days at 160° C., with stirring at 400 rpm. The product was filtered, washed and dried. X-ray diffraction analysis indicated it to be 100% crystalline ZSM-5.

Elemental analysis indicated the presence of 8.26% C, 1.88% H, 0.74% N, 0.34% Na, 4.33% Tl, 80.65% $SiO_2$, and 0.0095% Al in the ZSM-5 product.

EXAMPLE 2

Catalyst preparation was undertaken as follows: The as-synthesized thallium silicate was calcined, first in nitrogen and then in air, at 520° C. The calcined zeolite contained 2.43% Tl, 38 ppm Al, and 43.15% Si.

Platinum was incorporated by ion exchange with $Pt(NH_3)_4Cl_2$ (15 mg/g zeolite) at room temperature. TGA ammonia titration in hydrogen indicated the presence of 0.67% Pt. The platinum-containing zeolite was then calcined in oxygen to 350° C. where it was maintained for one hour at 0.5° C./min.

EXAMPLE 3

The above catalyst of Example 2 was used to study the reforming of a hydrotreated Arab light naphtha, b.p. 180°–250° F. The reaction was run at 538° C. at atmospheric pressure at 1.8 WHSV and a $N_2$/HC ratio of 2.2. The results obtained are shown below:

| | Feed | Product | % Converted |
|---|---|---|---|
| $C_1$–$C_4$ | 0 | 0.4 | |
| Methylpentanes | 16.5 | 11.6 | 30% |
| n-Hexane | 24.2 | 12.2 | 50% |
| Methylhexanes | 15.6 | 11.8 | 24% |
| n-Heptane | 17.1 | 7.2 | 58% |
| Benzene | 2.1 | 14.0 | |
| Toluene | 3.2 | 11.5 | |

Preliminary screening of the thallium-modified non-acidic Pt/ZSM-5 catalyst described above for the reforming of a hydrotreated Arab light naphtha, b.p. 180°–250° F., indicated highly selective aromatics formation together with very low $C_1$–$C_4$ gas production. At 538° C., atmospheric pressure, 1.8 WHSV, and a $N_2$:HC ratio of 2.2, preferential conversion of the normal paraffins to benzene and toluene was observed, as shown above.

EXAMPLE 4

Lead-containing ZSM-5 was synthesized. A solution A was prepared by dissolving 3:31 g $Pb(NO_3)_2$ in 338.8 g de-ionized water. A solution B was prepared by dissolving 12.4 g NaOH in 300 g de-ionized water. 23.94 g TPA bromide was then dissolved in solution B, which was then poured into solution A. 60.0 g silica gel (SPEX Ind.) was placed in a 1-liter stainless steel autoclave. The solution was now transferred to the autoclave, and the mixture was stirred for two minutes before sealing the autoclave. Stirring and heating were begun immediately. The composition of the hydrogel formed is described by the following mole ratios:

| $SiO_2/Pb$ | $H_2O/SiO_2$ | $OH^-/SiO_2$ | $Na^+/SiO_2$ | $TPA^+/SiO_2$ |
|---|---|---|---|---|
| 90 | 40 | 0.30 | 0.34 | 0.10 |

The zeolite crystallization was carried out at 160° C. with stirring at 400 rpm for 4 days. The product ZSM-5 analyzed for 7.96% C, 0.7% N, 0.97% Na, 4.0% Pb, 86.48% ash, and 235 ppm $Al_2O_3$. Platinum incorporation was similar to that in Example 2.

What is claimed is:

1. A process for reforming a naphtha feedstock of low octane value comprising contacting the feedstock, under reforming conditions, with a non-acidic catalyst composition consisting essentially of a reforming hydrogenation/dehydrogenation metal in combination with a non-acidic microporous crystalline material containing thallium or lead, and wherein said non-acidic microporous crystalline material is isostructural with a zeolite, selected from the group consisting of ZSM-5, ZSM-11, ZSM-12, ZSM-20, ZSM-23, ZSM-48, ZSM-50, and zeolite beta, recovering a reformate having an octane value greater than that of the feedstock and having an aromatic content greater than that of the feed.

2. The process of claim 1, wherein said reforming metal comprises 0.1 to 20 weight percent of the catalyst and said thallium or lead comprises 0.05 to 20 weight percent of the combination.

3. The process of claim 1, wherein said reforming conditions further includes adding hydrogen to the feedstock.

4. The process of claim 1, wherein the naphtha feedstock comprises a light naphtha fraction of $C_6$ to 250° F. boiling range components.

5. The process of claim 1, wherein the naphtha feedstock is separated into at least two fractions including a fraction containing $C_6$–$C_7$ paraffins wherein said fraction is contacted with said catalyst.

6. The process of claim 5, wherein a second fraction of said two fractions is contacted with a conventional reforming catalyst.

7. The process of claim 1, wherein the zeolite is ZSM-5.

8. The process of claim 1, wherein the aluminum content of the non-acidic crystalline microporous material is less than 0.1 weight percent.

9. The process of claim 1, wherein the aluminum content of the non-acidic microporous crystalline material is less than 0.02 weight percent.

10. The process of claim 1, wherein the reforming metal is a Group VIII metal.

11. The process of claim 1, wherein the hydrogenation/dehydrogenation metal is a platinum group metal.

12. The process of claim 1, wherein the hydrogenation/dehydrogenation metal is platinum.

13. The process of claim 1, wherein the pressure of the reforming conditions ranges from 0 to 500 psig.

14. The process of claim 5 wherein the pressure of reforming ranges from 0 to 500 psig.

15. The process of claim 5, wherein the liquid yield exceeds the liquid yield of reforming undertaken in the presence of the non-acidic crystalline microporous material free of said thallium or lead.

16. The process of claim 14, wherein the temperature of reforming ranges from 800° to 1100° F.

17. The process of claim 1, wherein the feedstock, prior to said contacting, is subjected to fractionation to remove the fraction boiling below about 150° F.

18. The process of claim 17, which further includes contacting a fraction boiling above about 250° F. with a reforming catalyst, at a temperature of 800° to 1100° F.; $H_2$/HC (feed) ratio of 1 to 20:1; LHSV of 0.1 to 20 $hr^{-1}$.

19. The process of claim 18, wherein the fraction boiling below about 250° F. is contacted under said reforming conditions with said combination of non-acidic microporous crystalline material containing thallium or lead and said reforming hydrogenation/dehydrogenation metal.

20. The process of claim 1, wherein the liquid yield exceeds the liquid yield of reforming undertaken in the presence of the non-acidic crystalline microporous material free of said thallium or lead.

21. In a process for reforming a naphtha feedstock of low octane value, wherein reforming includes cracking, hydrocracking, hydrogenolysis, isomerization and dehydrocylization, the improvement comprising increasing the selectivity of reforming to produce dehydrocyclization products and substantially eliminating products of cracking, hydrocracking, hydrogenolysis and isomerization which process comprises contacting the feedstock, under reforming conditions, with a non-acidic catalyst composition comprising a reforming hydrogenation/dehydrogenation metal in combination with a non-acidic microporous crystalline material containing thallium of lead, and recovering a reformate having an octane value greater than that of the feedstock and having an aromatic content greater than that of the feed.

22. The process of claim 21, wherein said reforming metal comprises 0.1 to 20 weight percent of the catalyst and said thallium or lead comprises 0.05 to 20 weight percent of the combination.

23. The process of claim 21, wherein said reforming conditions further includes adding hydrogen to the feedstock.

24. The process of claim 21, wherein the naphtha feedstock comprises a light naphtha fraction of $C_6$ to 250° F. boiling range components.

25. The process of claim 21, wherein the naphtha feedstock is separated into at least two fractions including fraction containing $C_6$–$C_7$ paraffins wherein said fraction is contacted with said catalyst.

26. The process of claim 25, wherein a second fraction of said two fractions is contacted with a conventional reforming catalyst.

27. The process of claim 21, wherein said non-acidic crystalline microporous material is isostructural with a zeolite, selected fgrom the group consisting of ZSM-5, ZSM-11, ZSM-12, ZSM-20, ZSM-23, ZSM-48, ZSM-50, and zeolite beta.

28. The process of claim 21, wherein the zeolite is ZSM-5.

29. The process of claim 21, wherein the aluminum content of the non-acidic crystalline microporous material is less than 0.1 weight percent.

30. The process of claim 21, wherein the aluminum content of the non-acidic microporous crystalline material is less than 0.02 weight percent.

31. The process of claim 21, wherein the reforming metal is a Group VIII metal.

32. The process of claim 21, wherein the reforming metal is a platinum group metal.

33. The process of claim 21, wherein the reforming metal is platinum.

34. The process of claim 21, wherein the pressure of the reforming conditions ranges from 0 to 500 psig.

35. The process of claim 5 wherein the pressure of reforming ranges from 0 to 500 psig.

36. The process of claim 25, wherein the liquid yield exceeds the liquid yield of reforming undertaken in the presence of the non-acidic crystalline microporous material free of said thallium or lead.

37. The process of claim 35, wherein the temperature of reforming ranges from 800° to 1100° F.

38. The process of claim 21, wherein the feedstock, prior to said contacting, is subjected to fractionation to remove the fraction boiling below about 150° F.

39. The process of claim 38, which further includes contacting a fraction boiling above about 250° F. with a reforming catalyst, at a temperature of 800° to 1100° F.; $H_2$/HC (feed) ratio of 1 to 20:1; LHSV of 0.1 to 20 $hr^{-1}$.

40. The process of claim 39, wherein the fraction boiling below about 250° F. is contacted under said reforming conditions with said combination of non-acidic microporous crystalline material containing thallium or lead and said reforming hydrogenation/dehydrogenation metal.

* * * * *

UNITED STATES PATENT AND TRADEMARK OFFICE

CERTIFICATE OF CORRECTION

PATENT NO. : 4,882,040

DATED : November 21, 1989

INVENTOR(S) : Ralph M. Dessau and Ernest W. Valyocsik

It is certified that error appears in the above-identified patent and that said Letters Patent is hereby corrected as shown below:

Col. 2, Line 40 change "THe" to -- The --

Col. 5, Line 39 change "VII" to -- VIII --

Signed and Sealed this

Twenty-first Day of May, 1991

*Attest:*

HARRY F. MANBECK, JR.

*Attesting Officer*

*Commissioner of Patents and Trademarks*